United States Patent [19]

Brown et al.

[11] Patent Number: 4,786,532

[45] Date of Patent: Nov. 22, 1988

[54] FLEXOGRAPHIC PRESS APPLIED PAPER COLOR COATING

[75] Inventors: Richard C. Brown, Somers, Conn.; Robert E. Lafler, Charlton City; Joseph M. Murphy, Wilbraham, both of Mass.

[73] Assignee: Westvaco Corporation, New York, N.Y.

[21] Appl. No.: 48,306

[22] Filed: May 11, 1987

Related U.S. Application Data

[62] Division of Ser. No. 766,647, Aug. 19, 1985, abandoned.

[51] Int. Cl.[4] ..... B05D 1/28

[52] U.S. Cl. ..... 427/428; 493/264

[58] Field of Search ..... 427/428, 207.1, 208.6; 493/264, 328, 331

[56] References Cited

U.S. PATENT DOCUMENTS 2,293,690 8/1942 Harrigan ..... 427/428 X

OTHER PUBLICATIONS

Oberg, E. and Jones, F. D., "Machinery's Handbook", 17th ed., New York, NY, Industrial Press Inc., 1966, pp. 2040–2043d.

"Instructions, Surface-Roughness Scales," Specification Sheet, GEJ-4136, General Electric Co., undated.

*Primary Examiner*—Evan Lawrence

*Attorney, Agent, or Firm*—W. A. Marcontell; R. L. Schmalz

[57] ABSTRACT

This process is directed to the coloration of envelope and stationery grades of white paper stocks with a water based ink coating. Characteristics of the flexographic process include both press and ink specifications. Critical mechanical or material characteristics are associated with each of the fountain roll, the anilox roll, the plate roll and the impression roll of a flexographic printing system. Used in conjunction with the critical combination of press characteristics is a unique, water-based ink formulation for rapidly coloring an entire web side with a colored ink to simulate the appearance of a colored paper stock.

3 Claims, 1 Drawing Sheet

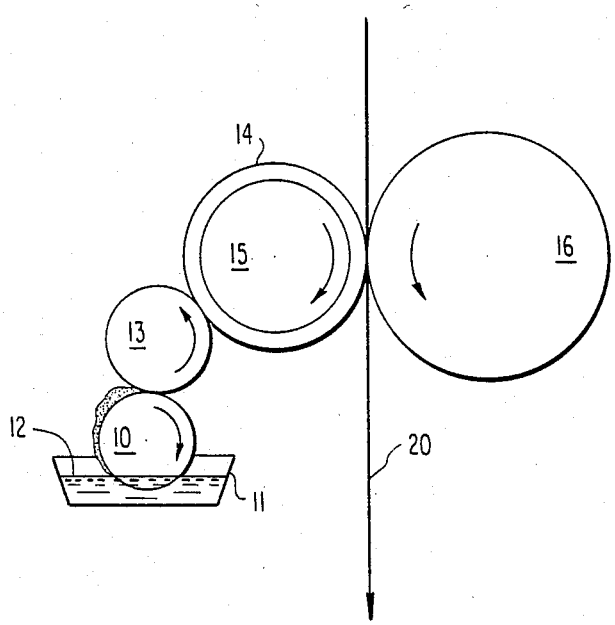
14
15
16
13
12
10
11
20

FLEXOGRAPHIC PRESS APPLIED PAPER COLOR COATING

This is a division of application Ser. No. 766,647 filed 8-19-85, now abandoned.

BACKGROUND OF THE INVENTION

1. Field of the Invention

The present invention predominately relates to flexographic printing processes. More particularly, the invention relates to a process for uniformly applying a water-based color coating or ink to the entire surface area of a paper web side which represents the material supply for a converting apparatus such as an envelope machine.

2. Description of the Prior Art

Large numbers of stationery users require or desire colored envelopes and/or letter sized paper. For standardized colors, sizes and shapes, colored stationary needs are met with colored paper in which the colorant is blended with the paper stock before a web therefrom is laid on a papermachine. By this process, economics require large orders and inventories of a given paper color.

Small orders of uniquely colored envelopes are particularly difficult to meet, economically. Traditionally, such envelopes have been manufactured from white, substantially uncoated paper by a process which includes a flexographic print coating of the envelope machine supply web with a coating of solvent based ink: except in those areas where the envelope gum or adhesive is to be applied. This exception was necessary to accommodate the fact that the usual non-toxic envelope gums will not adhere to solvent ink coated surfaces.

Notwithstanding the gum adherence difficulty with solvent-ink, water-based inks have not been used in these applications due to the curling consequences of water-based ink upon the web. Envelope machines are extremely critical with requirements of a flat, uniform web surface. Excess water vehicle absorbed by the web from the prior art water-based inks made the supply web warp, wave and curl.

SUMMARY OF THE INVENTION

It is, therefore, an object of the present invention to teach a water-based ink formulation and process of applying it that will not curl or distort a substantially uncoated paper web.

Another objective of the present invention is to teach a method of color coating an envelope machine supply web without the necessity of color omitted print areas to accommodate traditional gum adhesives.

Another objectives of the present invention is to teach a converting machine supply web coloring process having such economic advantage over solvent based coloring systems as to reduce the ink costs of such colored envelopes by 30%–40%.

In accordance with the present invention, a paper supply web to an envelope converting machine is uniformly coated on one surface with a water-base ink using a flexographic printing apparatus. Critical mechanical or material characteristics are associated with each of the fountain roll, the anilox roll, the plate roll and the impression roll of the apparatus.

BRIEF DESCRIPTION OF THE DRAWING

The single FIGURE of the drawing schematically illustrates those elements of a flexographic printing machine to which the invention specifically relates.

DESCRIPTION OF THE PREFERRED EMBODIMENT

Practice of the present invention requires coordination of flexographic printing machine parameters along with ink formulation parameters. The printing machine is schematically illustrated by the drawing to include a rubber or elastomer covered fountain roll 10 disposed to rotate within an ink reservoir 11. An immersed chordal section of the fountain roll picks up ink by surface adhesion from the ink pool 12 for metered delivery to the surface of an anilox roll 13. Characteristic of an anilox roll is a textured surface which regulates the quantity of ink carried by the texture cell volume.

Ink held by the texture cells of the anilox roll 13 is transferred to the image plate 14 carried by a plate cylinder 15. Conventionally, the plate surface is profiled with raised surface elements in the image pattern to be transferred to the web 20. Impression roll 16 provides a resilient backing surface for nip confinement of the web 20. In the present invention, however no image pattern is desired and the surface of image plate 14 is smooth.

Among these prior art elements of the present flexographic machinery are a combination of critical characteristics and mechanical parameters essential to successful practice of the invention.

Although the fountain roll 10 is traditionally covered by rubber or similar elastomer, the present invention requires about a Shore "A" durometer cure of 85 to 90 and an unusually fine finish of approximately 64 microinches surface roughness height.

Combined with the aforesaid special fountain roll is a laser engraved ceramic coated anilox roll 13 having a 380–408 lines per inch tight packed interlaced pattern with cell depth values of 19–21$\mu$. While we have found this to give optimum results, we have also had satisfactory results with a mechanically engraved 400 P (pyramid) anilox roll with cell depths of 17–20$\mu$. Unique utility of the invention is in a continuous web 20 flow combination with a converting apparatus such as an envelope machine not shown. A mechanically engraved anilox roll 13 more coarse than the 400 P and a laser engraved ceramic coated anilox roll more coarse than the 380–408 lines per inch will curl the web by transfer of an excessive volume of water. Such curling is intolerable to the converting machine which requires a smooth, flat web for uninterrupted operation. The allowable range of 17–40$\mu$ cell depth is used with discretion to regulate color strength and coverage.

In lieu of image profiled plates secured to the plate roll 15, a continuous elastomer covering 14 of approximately $\frac{1}{8}$ inch thickness is provided for the invention. Suitable elastomers may include natural rubber, ethylene propylene, nitrile, vinyl and polyurethane. Such elastomer cover is cured to 50–55 Shore "A" durometer hardness and given a surface finish of approximately 32 microinches surfaces roughness height. Cylindrical concentricity must be within 0.001 in.

The impression roll 16 of the invention combination is conventional for the prior art except for a 0.001 in. concentricity specification which is unusually accurate.

The ink element of the present coating system is basically a pigment color base combined in a water miscible resin binder carried by a water vehicle. The binder, Cartaretin F-4, is a proprietary cationic polyamide-amine resin product of the Sandoz Colors and Chemicals Co., 400 Monroe Road, Charlotte, N.C. 28205.

Formulations of the ink as represented by the following examples are prepared with a 15 to 16.5 second, No. 2 Zahn cup viscosity and 35–39 dynes/cm surface tension. Coverage uniformity is regulated by surface tension adjustment achieved by additions of ethyl alcohol in quantities of up to 10% of the mixture. These formulations are concentrates intended for approximately 1:1 water dilution prior to machine use. A particular machine will dictate the exact dilution ratio relative to desired color strength or intensity.

| EXAMPLE I - Ivory | |
|---|---|
| Water | 39.58% wt. |
| Monoethanolamine | 2.00 |
| Graphtol Yellow 4532-2 | 14.00 |
| Graphtol Orange 3333-2 | 4.00 |
| Cartaretin F-4 | 40.00 |
| Foamaster H | 0.02 |
| | 100.00% |

Monoethanolamine is a nitrogen compound of the alkanolamines family used to stabilize the mixture pH and preserve pigment dispersion. Graphtol Yellow 4534-2 and Graphtol Orange 3333-2 are proprietary pigment products of the Sandoz Colors and Chemicals Co., 4000 Monroe Road, Charlotte, N.C. 28205. Foamaster H is a proprietary defoaming agent of the Diamond Shamrock Chemicals Co., 350 Mt. Kemble Ave., Morristown, N.J. 07960.

| EXAMPLE II - Light Yellow | |
|---|---|
| Water | 25.98% wt. |
| Monoethanolamine | 2.00 |
| Graphtol Yellow 4534-2 | 32.00 |
| Cartaretin F-4 | 40.00 |
| Foamaster H | 0.02 |
| | 100.00% |

| EXAMPLE III - Blue | |
|---|---|
| Water | 59.48% wt. |
| Monoethanolamine | 2.00 |
| Artilene Blue 6812-5 | 8.50 |
| Cartaretin F-4 | 30.00 |
| Foamaster H | 0.02 |
| | 100.00% |

Artilene Blue 6812-5 is the proprietary pigment product of Sandoz Colors and Chemicals Co.

| EXAMPLE IV - Green | |
|---|---|
| Water | 31.08% wt. |
| Monoethanolamine | 2.00 |
| Graphtol Yellow 4534-2 | 16.40 |
| Graphcol Green 5869-2 | 4.00 |
| Artilene Blue 6812-5 | 6.50 |
| Cartaretin F-4 | 40.00 |
| Foamaster H | 0.02 |
| | 100.00% |

Graphtol Green 5869-2 is the proprietary pigment product of Sandoz Colors and Chemicals Co.

| EXAMPLE V - Gray | |
|---|---|
| Water | 74.10% wt. |
| Monoethanolamine | 1.00 |
| Carta Black BI Liquid 50% | 4.70 |
| Cartaretin F-4 | 20.00 |
| Foamaster H | 0.20 |
| | 100.00% |

Carta Black BI Liquid 50% is the proprietary pigment product of Sandoz Colors and Chemicals Co.

| EXAMPLE VI - Pink | |
|---|---|
| Water | 54.24% wt. |
| Monoethanolamine | 0.75 |
| Graphtol Red 1111-2 | 30.00 |
| Cartaretin F-4 | 8.00 |
| Foamaster H | 0.01 |
| Print Base GP | 7.00 |
| | 100.00% |

Graphtol Red 1111-2 is the proprietary pigment product of Sandoz Colors and Chemicals Co. Print Base GP is an organic solution of a rosin derived resin and the proprietary product of Sandoz Colors and Chemicals Co.

In addition to the previously described environmental advantages of the invention pertaining to elimination of toxic and hazardous vapor emissions, the invention also has the economic advantage of 30% to 40% savings in the finished envelope ink cost. At a 1400 fpm web speed, no converting machine production rate compromise is required of the present invention.

Having fully described our invention

We claim:

1. A method of uniformly coloring with a water-based ink one surface of a substantially uncoated, continuous paper supply web to an envelope converting machine comprising the steps of:

passing said continuous supply web tbhrough a flexographic printing apparatus prior to subsequent converting steps;

metering the transfer of water-based ink from a supply pool to said web with a nip linked train of rotating rolls comprising an elastomer covered fountain roll that is partially immersed in said supply pool and in rolling nip contact with an anilox roll, said anilox roll also being in rolling nip contact with an elastomer covered plate roll, said web being passed through a rolling pressure nip between said plate roll and an impression roll;

formulating said water-based ink with 20% to 40% by weight of a water miscible resin binder for color pigment;

adjusting the viscosity of said water-based ink to the approximate range of 15 to 16.5 seconds, No. 2 Zahn Cup;

adjusting the surface tension of said water-based ink to the approximate range of 35 to 39 dynes per centimeter;

forming said plate cylinder elastomer cover with a 50–55 Shore "A" durometer hardness cure, cylindrically trued to a 0.001 concentricity and surface finished to a surface roughness height of about 32 microinches;

forming said impression roll with a 0.001 inch cylindrically trued surface concentricity;

providing said anilox roll with a 400 P engraved surface texture having approximately 17 to 20μ cell depth or a ceramic coating engraved with 19 to 21μ deep cells distributed over an interlaced pattern of 380 to 408 lines per inch; and, forming said fountain roll elastomer cover with about an 80 to 90 Shore "A" durometer hardness cure and surface finished to a surface roughness height of approximately 64 microinches.

2. A method as described by claim 1 wherein said anilox roll is provided with a 400 P engraved surface texture having approximately 17 to 20μ cell depth.

3. A method as described by claim 1 wherein said anilox roll is provided with a ceramic coating engraved with 19 to 21μ deep cells distributed over an interlaced pattern of 380 to 408 lines per inch.

* * * * *

UNITED STATES PATENT OFFICE

CERTIFICATE OF CORRECTION

PATENT NO. : 4,786,532

DATED : November 22, 1988

INVENTOR(S) : R. C. Brown, R. E. Lafler and J. M. Murphy

It is certified that error appears in the above-identified patent and that said Letters Patent are hereby corrected as shown below:

Column 2, line 53, "17-40" should be --17-20--. Column 4, line 41 (Claim 1, line 5), "tbhrough" should be --through--.

Signed and Sealed this

Eighteenth Day of April, 1989

*Attest:*

DONALD J. QUIGG

*Attesting Officer*

*Commissioner of Patents and Trademarks*